US005978964A

United States Patent [19]

Gaston

[11] Patent Number: 5,978,964

[45] Date of Patent: Nov. 9, 1999

[54] EXERCISE APPAREL AND ASSOCIATED WEIGHT

[75] Inventor: Kerry R. Gaston, 2724 W. Aberdine Dr., Montgomery, Ala. 36116

[73] Assignee: Kerry R. Gaston, Montgomery, Ala.

[21] Appl. No.: 08/829,086

[22] Filed: Mar. 31, 1997

Related U.S. Application Data

[63] Continuation-in-part of application No. 08/447,061, May 22, 1995, abandoned.

[51] Int. Cl.[6] ..... A41B 1/00

[52] U.S. Cl. ..... 2/69; 2/228

[58] Field of Search ..... 2/69, 115, 227, 2/228, 238; 482/98, 119, 120, 128, 105

[56] References Cited

U.S. PATENT DOCUMENTS

| | | | |
|---|---|---|---|
| 3,114,982 | 12/1963 | McGowan . | |
| 3,490,766 | 1/1970 | Gardner | 482/93 |
| 3,759,510 | 9/1973 | Jackson, Jr. . | |
| 4,239,211 | 12/1980 | Wilkerson | 482/119 |
| 4,326,706 | 4/1982 | Guthrie et al. . | |
| 4,384,369 | 5/1983 | Prince . | |
| 4,407,497 | 10/1983 | Gracie | 482/119 |
| 4,602,784 | 7/1986 | Budden et al. | 482/119 |
| 4,684,123 | 8/1987 | Fabry . | |
| 4,777,743 | 10/1988 | Roehrig, Jr. . | |
| 4,838,546 | 6/1989 | Winston . | |
| 4,953,856 | 9/1990 | Fox, III . | |
| 4,958,386 | 9/1990 | Louis-Jeune . | |
| 4,989,267 | 2/1991 | Watson . | |
| 4,997,183 | 3/1991 | Winston . | |
| 5,002,270 | 3/1991 | Shine . | |
| 5,010,596 | 4/1991 | Brown et al. . | |
| 5,033,117 | 7/1991 | Fairweather . | |
| 5,048,125 | 9/1991 | Libertini et al. . | |

*Primary Examiner*—Gloria Hale
*Attorney, Agent, or Firm*—Leydig, Voit & Mayer, Ltd.

[57] ABSTRACT

A sportswear garment manufactured from a form-fitting clothing article having at least one flexible weight and a plurality of pockets to receive and maintain the weights in an immobile manner is provided. The garment may be provided in a variety of forms including for fitting various body portions. The apparel items are constructed of lightweight, durable form-fitting fabrics that conform to the body of the athlete when worn. Various pocket styles and positionings are possible. The flexible weights may have a flexible metal core surrounded by a cushioning layer and/or a plastic coating on the cushioning layer. In another embodiments, weights are provided having a body comprising a thermoplastic elastomer containing a finely divided mineral filler, the body preferably being covered by an expandible knit material. A method is also provided for manufacturing the latter type of weight.

44 Claims, 3 Drawing Sheets

EXERCISE APPAREL AND ASSOCIATED WEIGHT

CROSS-REFERENCE TO RELATED APPLICATION

This is a continuation-in-part of U.S. Ser. No. 08/447,061, filed May 22, 1995 now abandoned.

BACKGROUND OF THE INVENTION

The present invention generally relates to a flexible weight. More specifically, the present invention relates to a weight which is securable to a human body during exercise, or, in an embodiment, for use in form-fitting exercise garments which carry a flexible weights for enhanced athletic training.

Athletic competitors in sports today utilize a variety of devices to increase strength, quickness and muscular development during their training. Weight lifting and running are integral parts of any workout for athletes in many disciplines. Many attempts have been made to provide athletic clothing that is weighted to provide additional resistance to the athlete when the article is worn during exercise. One such article is an ankle weight. However, the addition of weight to other garments is also known.

For example, U.S. Pat. No. 5,048,125 discloses athletic sportswear having at least two layers of fabric attached together to form the article. The layers are provided with a plurality of regions between the layers which are filled with particles to add weight to the garment.

Also, in U.S. Pat. No. 3,759,510 a composite exercise garment includes a plurality of compartments which were loaded with particulate weighting materials such as sand, lead shot, or sawdust. However, this type of weighting is very cumbersome or impossible to change and does not provide for a variable amount of resistance for an athlete. A need exists, therefore, for form-fitting exercise apparel capable of carrying flexible weights of various sizes.

SUMMARY OF THE INVENTION

To this end, the present invention provides a complete line of exercise apparel capable of securely carrying a plurality of flexible weights that allow for enhanced power training. Each apparel item is designed for comfortable wear and use even without the addition of the weights. However, when a combination of the varying sizes of flexible weights is used with the clothing, the apparel article remains comfortable and becomes a force of resistance against a particular of muscle or set of muscles to provide a more rigorous workout for the wearer.

To this end, in an embodiment of the present invention, a form-fitting clothing article is provided having at least one flexible weight. Means for receiving and maintaining the at least one flexible weight immobile constructed and arranged on the clothing article is also provided.

In an embodiment, at least one flexible weight has a flexible metal core and a cushioning layer around the core. In another embodiment, a plastic coating is layered over the core. In an embodiment, a cushioning layer is provided around the core and a plastic coating is disposed over the cushioning layer.

In an embodiment, a plurality of flexible weights is provided wherein each weight has a colored exterior so that the weights may be color-coordinated with the clothing articles and/or so that the weights may be color-coded to indicate a relative heaviness thereof.

In an embodiment, a weighted clothing article provided in the form of a jersey. In other embodiments, the clothing article may be a pair of shorts, a pair pants, a vest, a jacket, ankle straps, a belt, a cap, a pair of shoes, a pair of gloves, or a wrist band.

In an embodiment, the clothing article includes a means for receiving one of the weights in a removably securable manner, such as a stretchable pocket for receiving a weight. Embodiments of such pockets could be straight, circumferentially displaced, spirally displaced about the form-fitting clothing article.

In an embodiment, the pocket has a flap which covers an opening of the pocket, and the flap is securable in a closed position with a hook-and-loop type fastener.

In an embodiment, the garment has at least one flexible, metal weight having a lead core.

In an embodiment, the garment is a form-fitting clothing article constructed of a stretchable fabric. In an embodiment, the form-fitting clothing article is constructed of a breathable fabric.

In an embodiment, the means for receiving the at least one flexible weight includes a designator indicative of the at least one flexible weight capable of fitting therein.

In an embodiment, the means for receiving includes a transparent pocket to facilitate viewing of a the weight therein. This is particularly advantageous in embodiments wherein the weight has a colored exterior. The color is decorative, and where the color indicates the weight, the user can more identify the particular weight without opening the pocket.

In another embodiment of the present invention, an exercise garment is provided. The garment comprises a clothing article capable of conforming to the body of a wearer, the clothing article having an exterior surface; at least one flexible rod-like weight; means for removably carrying the at least one flexible rod-like weight constructed and arranged on the exterior surface of the clothing article, the means for removably carrying the weight maintaining the weight immobile there within. In various embodiments, the rod-like weight may have a flexible metal core or a flexible body formed from an elastomer/filler composition.

In an embodiment, the present invention provides an improved weight which is resilient and flexible. This weight includes a weight body formed of a thermoplastic elastomer having a mineral filler interspersed therein. The thermoplastic elastomer may be various synthetic or natural rubber compositions, and the filler may be a finely divided metal powder. For example, in an embodiment, the filler is iron powder and/or lead powder. The weight may shaped for cooperative insertion into a pocket of an exercise garment. The weight may also be otherwise securable to a human body, such as by providing a plastically-bendable member in the weight to facilitate a wrap-around securing of the weight to an ankle or wrist.

In a further embodiment, the flexible weight is covered by a resilient, expandible knit material. Such a material is advantageous because the knit material enhances comfort against skin or clothing. Additionally, in an embodiment wherein the weight is insertable into a cooperatively-shaped garment pocket, the knit material reduces dynamic friction of the weight against the garment material for easy insertion and removal, and has been found to also provide enhanced static friction to retain the weight immobile within a pocket.

The invention further includes a method of manufacturing such a flexible weight. To this end, in an embodiment, a method of making a weight is provided including mixing the thermoplastic elastomer with the filler. The method then includes forming the mixture into a desired shape. The forming step may include various shaping means, such as extruding the mixture onto a surface or into shaped molds. A long extruded segment may be cut apart when the mixture is at least partially cured, the weights may be cut into weight body segments. Another shaping means may include injection molding the mixture into a mold having a desired weight body shape. The method may further include the covering of the weight body with a knit covering.

It is, therefore, an advantage of the present invention to provide a sportswear garment that conforms to the body of the wearer.

Moreover, it is an advantage of the present invention to provide a sportswear garment capable of carrying a variety of different sizes of flexible weights, enabling an athlete to customize his weight-enhanced workout by locating weights at selected positions of the garment and by selecting the size of such weights.

It is another advantage of the present invention to provide a sportswear garment having user-accessible pockets for conveniently changing the weights.

Another advantage of the present invention is to provide a sportswear garment that can be specifically altered for a particular use so that a specific muscle can be exercised.

A further advantage of the present invention is to provide a sportswear garment having a plurality of flexible weights that conform to the contours of the body of the wearer.

A still further advantage of the present invention is to provide a flexible weight which is easy to manufacture and which is comfortable and versatile.

Additional features and advantages of the present invention are described in, and will be apparent from, the detailed description of the presently preferred embodiments and from the drawings.

DETAILED DESCRIPTION OF THE PREFERRED BMBODIMENTS

Figure 1:
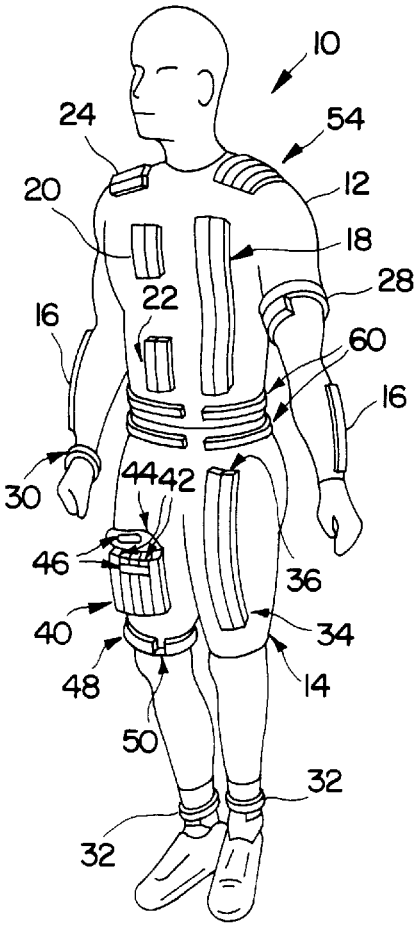
FIG. 1 is a front perspective view illustrating an athlete wearing an embodiment of exercise apparel constructed in accordance with the present invention.

Referring now in detail to the drawings, an athlete 10 is shown wearing embodiments of the sportswear exercise apparel of the present invention. FIG. 1 illustrates a jersey 12 and a pair of shorts 14. However, any other apparel item can also be manufactured in accordance with the present invention. For example, other apparel articles include: a jacket, a vest, ankle straps, wristbands, a pair of pants, gloves or shoes, a belt, a cap, etc.

A plurality of weight-receiving pockets are provided on the jersey 12. Specifically, the pockets are configured to receive and carry an cooperatively-shaped associated type of weight, for example, the rod-like weight 15 shown in FIG. 3. One of the types of weight pockets is a forearm weight pocket 16. The forearm weight pocket 16 is oriented longitudinally along the forearm of the athlete 10. Another longitudinally mounted weight pocket is a chest weight pocket 18. In addition, a pectoral weight pocket 20 is provided on the pectoral (chest) muscle of the athlete 10, and an abdominal weight pocket 22 is provided over the abdominal muscles of the athlete 10. Also, a plurality of epaulet type weight pockets 24 are provided on the shoulder area of the athlete 10.

In addition to the weights being carried in the pockets, an embodiment of the present invention provides that the weight 15 is preferably flexible. As a consequence of the flexibility, the weight 15 can be coiled (see FIG. 4) and worn around the body of the athlete 10. For example, a coiled biceps weight 28 is illustrated in FIG. 1. Similarly, a coiled wrist weight 30 is positioned at the wrist of the athlete 10. Also, coiled ankle weights 32 are shown in FIG. 1. The coiled weights 28, 30, 32 are capable of remaining on the body of the athlete 10 without the assistance of a pocket. This feature provides for greater flexibility in the positioning of the weights on the athlete. As a result, the specific muscle to be worked by the athlete can be individually selected and additional weight resistance can be applied thereto.

The shorts 14 illustrated in FIG. 1 show other embodiments for the placement of the pockets and carrying of the weights 15. For example, a longitudinal quadriceps weight pocket 34 is illustrated on the left leg of the athlete 10. Also illustrated in FIG. 1 is an opening 36 for insertion of the weight 15 into the weight holding pocket 34. Each pocket has such an opening to allow insertion of the desired weight 15. The pocket itself is preferably constructed to provide an elastic and tight fit for the weights carried therein. For example, a stretchable fabric is preferably used to basically squeeze the weight held therein. To this end, the pocket may be sized slightly smaller than the weight so that some stretching of the pocket is necessary when the weight is inserted. In this manner, the weights are snugly held in the pockets which are firmly against the body of the wearer of the form-fitting apparel article of the present invention.

An alternate embodiment of the present invention utilizes a multi-compartment pocket 40 as illustrated on the right leg of the athlete 10. The multi-compartment pocket 40 has a plurality of openings 42 designed to accept different weights 15. The multi-compartment pocket 40 also has a flap 44 which may be securely closed over the openings 42 to maintain the weights 15 in the multi-compartment pocket 40. The flap 44 may be closed by means of snaps, buttons or hook-and-loop type (e.g., VELCRO®) fasteners. A hook-and-loop type fastener 46 is shown in FIG. 1.

In addition, a circumferential leg pocket 48 is illustrated at the lower part of the pair of shorts 14 on the right leg of the athlete 10. The circumferential pocket 48 has an opening 50 in which to insert the flexible weight 15.

Figure 2:
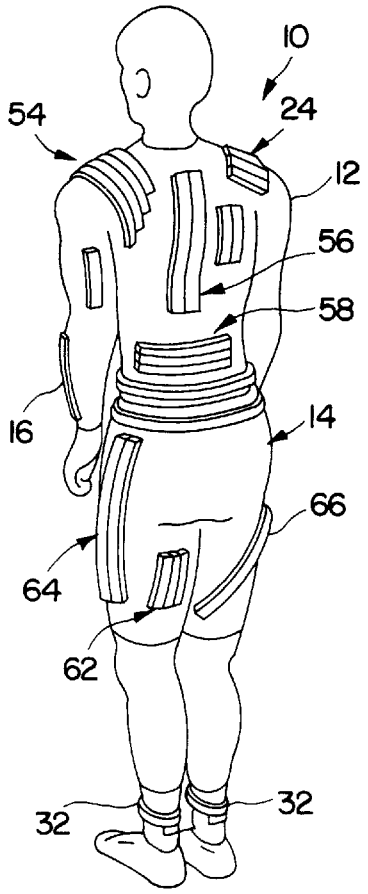
FIG. 2 is a rear perspective view illustrating an athlete wearing an embodiment of exercise apparel constructed in accordance with the present invention.

FIG. 2 illustrates other embodiments for placement of the pockets and weights on the athlete 10. For example, a plurality of draping shoulder weights 54 are located over the shoulder and down onto the shoulder blade of the athlete 10. Also, a pair of longitudinal spinal weight pockets 56 is provided in the center of the athlete's back.

In addition, a plurality of horizontally-displaced lumbar weight pockets 58 is provided. The lumbar weight pockets 58 provide for a large amount of weight to be carried on the wearer. The lumbar area is especially convenient to load with weights since locating the weight in this region does not obstruct the athlete's performance in many different physical activities.

Also, a circumferential waist weight pocket 60 can be provided either in the jersey 12 or in the shorts 14, or both. Alternatively, a belt-like weight garment may be provided (e.g., as described below in connection with FIG. 6). Now referring to the shorts 14 in FIG. 2, a multi-unit leg biceps weight pocket 62 is provided on the back of the leg of the athlete 10. In addition, for working the hip adductors, the shorts 14 have a pair of adductor weight pockets 64 longitudinally constructed in the pair of shorts 14. A further pocket embodiment, illustrated in FIG. 2, shows a spiral weight pocket 66 which may be oriented around the leg of the athlete 10 forming a general spiral shape. Further embodiments and orientations of the weights and pockets are, of course, also possible.

Figure 3:
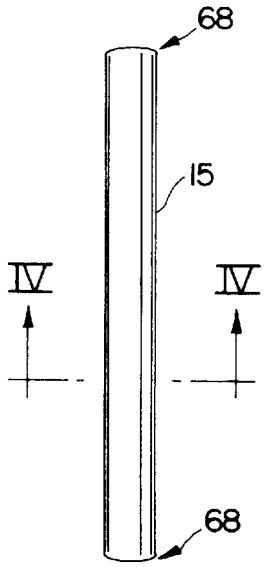
FIG. 3 is a front elevational view of an embodiment of a weight to be used in the apparel of the present invention.

Referring now to FIG. 3, an embodiment of the weight 15 is illustrated. Preferably, the weight 15 has smooth, rounded corners 68 which tend to be more comfortable for the athlete 10. The smooth, rounded corners 68 are also easier to insert into the openings of the pockets provided in the athletic apparel of the present invention.

Figure 4:
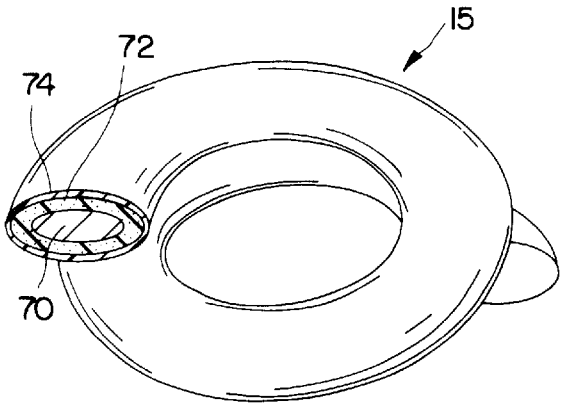
FIG. 4 is a cross-sectional view taken along section line IV—IV of FIG. 3 illustrating an embodiment of a weight in a coiled formation.

FIG. 4 illustrates an embodiment of the weight 15 in a coiled orientation. As described above, this type of orientation would preferably be used on the ankle, wrist or biceps of the athlete 10, and may be configured for use in a cooperatively shaped pocket, or directly over a limb member independently of a garment. In the latter configuration, the coiled weight may be resiliently formed in a shape slightly smaller than a particular limb member (ankle, wrist, etc.), when the weight is in a relaxed shape. Such a configuration resiliently biases the coil weight against the limb for a comfortably secure fit during exercise. Such a coil-shaped embodiment has been found particularly useful for enhancing leg weight during exercises performed in a seated body position, or in any exercise where increased leg weight is desired.

In the cross-sectional view of FIG. 4, an embodiment of the weight 15 has, for example, three layers. In the embodiment shown, an inner core 70 is provided. The inner core 70 is preferably a flexible, heavy metal such as a lead alloy. Alternatively, spiral weight 15 may have a coil-shaped weight body formed of a resilient elastomer/filler composition as described in greater detail below in connection with FIG. 5.

In the embodiment of FIG. 4, encasing the metal inner core 70 is a soft layer 72 which may be formed of some type of foam or other shock insulating and comfortable cushioning material. The soft layer 72 also provides thermal insulation. Finally, the soft layer 72 is encased in a protective layer 74. The protective layer 74 is may be a durable plastic coating or an expandible knit covering (e.g., such as that described below in connection with FIG. 5), either of which may be provided in a multitude of colors. The colors serve the utility of differentiating the weights by size and heaviness. For example, a red weight could indicate one pound, a blue weight two pounds, etc. In this manner, the athlete may quickly recognize and select the size weight desired. The aesthetics of the apparel may also be improved, since the weights 15 are capable of adding color to the garment. This provides a fashionable garment.

As explained above, each item of clothing has the pockets secured to, or formed on, the garment. In a fabric garment, the pockets are preferably sewn onto the outside, but possibly on the inside, of the garment. Where the garment material is a synthetic or rubber material, the pockets may be fused in place. The pockets are sized according to the shape of the particular set of weights that are designated for that pocket. When sewn, each of these pockets is preferably strongly stitched and restitched to ensure strength. Each pocket securely closes over the inserted weight as explained above, via the stretch properties of the fabric used in the present invention. The pockets may also be provided with a fastener that will not come open unless the wearer purposely opens that pocket.

A variety of weights may be provided for a particular pocket which are the same basic shape, but which vary in heaviness. Preferably, each weight is coded by color, number, or in some other manner to let the user know the heaviness of each weight and the correct pocket to which the weight belongs. As an added convenience, in an embodiment of the invention, the particular pocket for a specific size weight can be manufactured in the same color as the weight that fits into that pocket. As a result, the wearer can quickly and easily load the pockets with the most appropriate weights.

Most of the weights (at least as they pertain to the location on the user) are interchangeable. Each weight is also preferably covered in plastic or some other material to provide a soft or slightly padded exterior. The weights also have rounded edges and are slightly curved in order to conform, as closely as possible, to the shape of the body.

The complete line of apparel of the present invention includes jackets, shirts, vests, pants, socks, shoes, ankle and wrist bands and other specially designed articles of clothing. The items are made of lightweight, durable materials and conform to the body of the athlete. A typical material to be used is, for example, LYCRA® or SPANDEX®, although other form-fitting, durable fabrics are possible for use in the construction of the apparel of the present invention. The close fit is necessary to prevent injuries being caused by excessive movement of the weights. Because of the necessary close fit, the materials used in the clothing are very "breathable", thereby allowing the ready passage of air and moisture through the fabric.

As an example of the training proposed using the apparel of the present invention, a basketball player might work out in a vest, shorts and shoes. By initially placing light weights in the pockets, the athlete would perform the same basic drills as usual during practice, except now the muscles are worked harder because of the increased weight. Once the athlete became accustomed to the additional weight, the athlete may move up to the next level of weights, using heavier weights and perhaps more of them, and so on. In a subsequent game situation, without the burden of those weights, the athlete's enhanced muscles would perform at a higher level.

A further beneficial use proposed by the inventor for the sportswear garment of the present invention is as a therapeutic or rehabilitative aid for sports and/or occupational injuries. Specific clothing garments may be manufactured in accordance with the principles of the present invention to provide specialized rehabilitative garments to be worn by, for example, victims of sports injuries. An example of such a specialty garment would be a pair of shorts or pants constructed to have properly placed flexible weights to rehabilitate an injury to, for example, a knee. In addition, certain rehabilitations may be performed in a patient's own home for convenience and privacy during the rehabilitation period. An orthopedic surgeon or other physician, or a physical therapist in charge of the rehabilitation, could provide the patient with a specific garment for performing exercises at home to rehabilitate the injury suffered by the patient.

Figure 5:
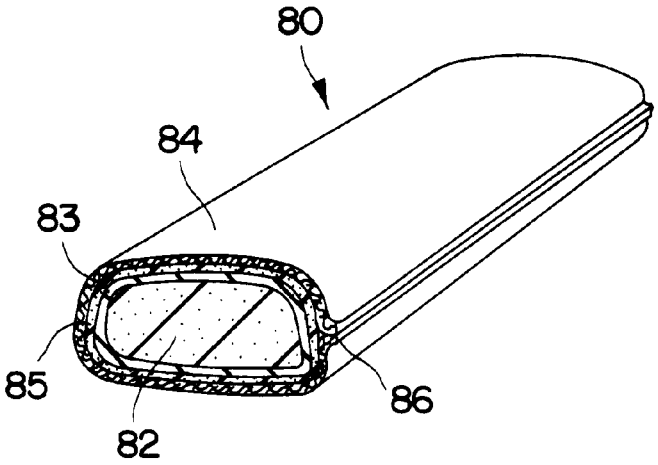
FIG. 5 is a perspective view of a weight having a body formed of a thermoplastic elastomer and mineral filler, according to an embodiment of the invention, a section being taken through a portion thereof.

Now turning to FIG. 5, a flexible, resilient weight 80 is illustrated. The weight 80 has a formed body 82 made of a thermoplastic elastomer composition with a mineral filler. The weight 80 may be configured rod-like for insertion into a pocket for the garments described above in connection with FIGS. 1 and 2. Suitable thermoplastic elastomers for the formed body 82 include: silicon rubber; styrene butadiene rubber; ethylene propylene rubber; EPDM rubber; polybutadiene rubber; polyisoprene rubber; and other synthetic or naturally occuring rubber.

The mineral filler is preferably a metal powder and suitable fillers may include iron, lead, or other heavy materials. The filler is finely divided, the particles preferably having an average size of 5–200 $\mu$m. A powder of 120 grain iron powder is known to provide suitable results. The filler particles are interspersed within the thermoplastic elastomer. A suitable formulation for the weight body has been an iron powder mixed into a silicon rubber caulking material commercially available from General Electric, however, other thermoplastic elastomer materials may be equally suitable and more practical economically.

The thermoplastic elastomer and mineral filler may be mixed in a wide range of proportions formulated to give desired resilience, flexibility, and weight. For example, the body 82 preferably consist of about 5–50% thermoplastic elastomer (by weight), and especially preferably about 15–25% thermoplastic elastomer (by weight). A formula of 15 parts thermoplastic elastomer to 100 parts 120-grain iron powder has been found to provide suitable results.

The weight body 82 has an exterior sealant layer 83 of thermoplastic elastomer. This sealant layer 83 prevents the filler material, such as an iron or lead powder, from contacting a user's skin. Furthermore, the sealant layer 83 helps prevent corrosion of the filler material due to exposure.

An embodiment of the weight 80 includes a knit sleeve or covering 84. This covering is preferably a resilient, expandible knit material, such as SPANDEX® or another synthetic knit fabric. The covering is fitted and secured over the weight. The covering 84 may be provided in a sheet which is wrapped over the weight, cut to size and then sewn, glued or fused to form seam 86 enclosing the weight body. In an embodiment including the sealant layer 83, the sealant layer 83 may additionally be useful as an adhesive to adhere the covering 84 to the body 82. Optionally, a padding layer 85 may reside between the sealant layer 83 and the covering 82.

The knit covering 84 enhances comfort in embodiments wherein the weight 80 could be used in direct contact with a person's skin or externally of clothing. Instead of a synthetic knit, the covering 82 could be a plastic or rubber coating.

The weight 80, as illustrated in FIG. 5, is rod-like and is suitable for use in the aforementioned garments and clothing articles. When used in such weighted sportswear garments having weight pockets (e.g., the apparel shown in FIGS. 1 and 2) the covering 84 reduces dynamic friction against the apparel fabric during insertion or removal of the weight 80 from a garment pocket. Additionally, it has been found that the same knit covering 84 also provides good static friction against the aforementioned garment and pocket material, retaining inserted weights in their pockets. The knit covering 84 may also be colored for aesthetic coordination with a garment or to correspond with a predetermined weight value or other characteristic.

Figure 6:
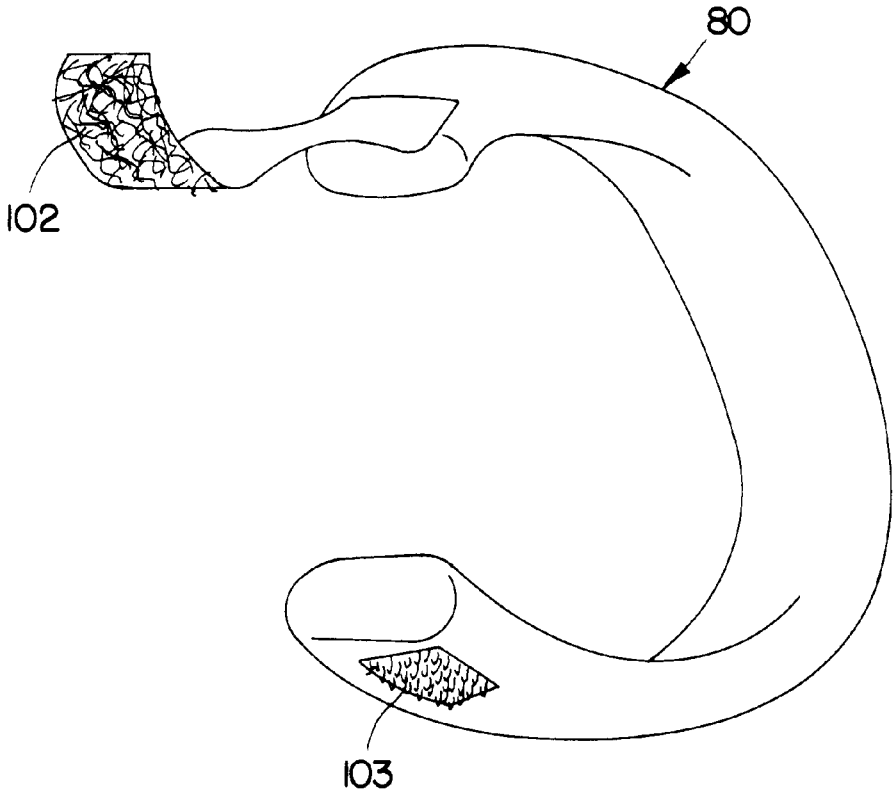
FIG. 6 is a perspective view of an elongated flexible weight according to an embodiment of the invention, configured to be flexibly secured around around a body member.

An embodiment of the weight 80 may be elongated and include a fastening means, as shown in FIG. 6. The embodiment of FIG. 6 is belt-like so that it is flexibly secureable around a body member, such as a waist, wrist, or ankle. In order to secure such a belt-like weight in place, a fastening means is provided to generally secure the weight 80 in an end-to-end fashion. For example, in the embodiment shown in FIG. 6, mated hook-and-loop fastening portions 102, 103 are secured at opposite ends of the weight.

Figure 7:
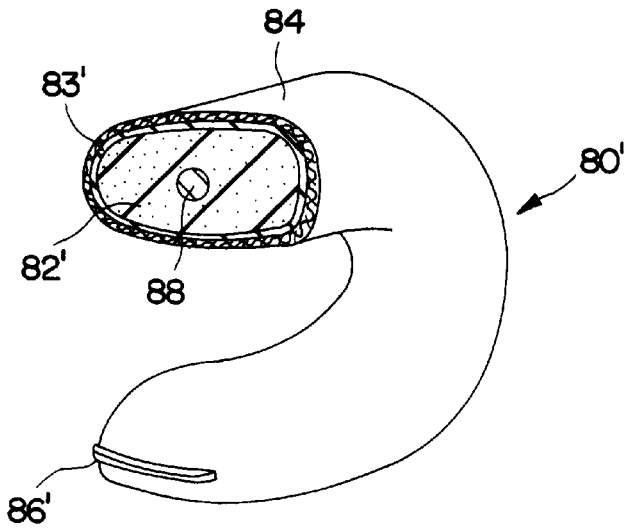
FIG. 7 is a perspective view of a bendable exercise weight having a weight body formed of a thermoplastic elastomer and mineral filler, and having a plastically deformable member located in the body, a section being taken through a portion thereof.

As shown in FIG. 7, a weight 80' also includes a weight body 82' formed of the thermoplastic elastomer with a heavy filler, as described in connection with FIG. 5. The weight 80' additionally includes a plastically bendable member 88 within the weight body 82'. The plastically bendable member 88 retains the shape of the weight 80 to conform to a particular shape when manually manipulated. For example, the weight 80' could be wrapped around an ankle or wrist, where it would retain its shape until unbent for removal. The plastically bendable member 88 may be made of a variety of durable, plastically deformable metals or metal alloys could be used, such as lead, and may be provided in a rod-like shape, as illustrated.

Still referring to FIG. 7, the weight 80' is shown having a knit covering 84' which is provided in tube form. In such an embodiment, the weight body 82' is inserted into the covering tube 84', which has a seamless circumference. At each end of the tube covering 84', an end-located seam 86' holds the tube closed to fully cover the weight body 82'.

Figure 8:
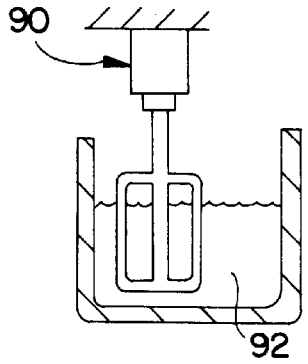
FIG. 8 is a schematic sectional view of a mixing apparatus mixing a thermoplastic elastomer and mineral filler mixture.

A method of making the improved weights are also provided. Referring to FIG. 8, the filler is mixed into the thermoplastic composition, using a stirring or mixing apparatus 90, to form a mixture 92 when the thermoplastic is in an uncured state. The mixture 92 is then formed into a desired shape.

Figure 9:
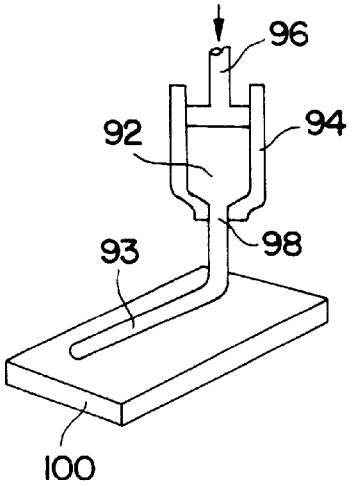
FIG. 9 is a schematic view of an extruder forming an extrusion of the thermoplastic and filler mixture.

For example, as illustrated in FIG. 9, an elongated extrusion 93 may be achieved by placing the uncured mixture 92 in a cylinder 94 and pressing the mixture 92 with a piston 96, extruding the mixture through an orifice 98 of a desired cross-sectional shape. The mixture 92 may be extruded onto a tray 100, or into a shaped mold. The extrusion 93 may be then cut into weight body segments of a desired length. Cutting may be performed before, after or during curing of the elastomer.

Another shaping means may include injection molding the mixture into a mold having a desired weight body shape. Additionally, the method may further include the covering of the weight body with a knit covering.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A sportswear garment comprising:

a form-fitting clothing article fitting closely on either the upper or lower torso;

a plurality of flexible elongate weights, each of the weights having a resiliency to generally conform to the curvature and movement of said body of the wearer along the length of the weight; and a plurality of pockets integral to the clothing article, each pocket being shaped for cooperatively receiving and maintaining one of the flexible elongate weights immobile against the torso, the pockets constructed and arranged in a plurality of different fixed and predetermined locations on the clothing article.

2. The sportswear garment of claim 1 further comprising:

a plurality of flexible weights wherein each weight is color-coded to indicate relative heaviness thereof.

3. The sportswear garment of claim 1 wherein the clothing article is a jersey.

4. The sportswear garment of claim 1 wherein the clothing article is selected from a group consisting of:

a pair of shorts, a pair pants, a vest, and a jacket.

5. The sportswear garment of claim 1 wherein at least one of the pockets further comprises:

at least one opening; and a flap constructed and arranged to cover the at least one opening.

6. The sportswear garment of claim 5 further comprising:

fastening means for securing the flap to the pocket.

7. The sportswear garment of claim 5 further comprising:

a hook-and-loop type fastener for securing the flap to the pocket.

8. The sportswear garment of claim 1 wherein at least one of flexible weights includes a designator indicative of the relative heaviness thereof.

9. The sportswear garment of claim 1 wherein the pocket is capable of stretching to receive the at least one weight therein, the pocket constructed and arranged on the form-fitting clothing article.

10. The sportswear garment of claim 1 wherein the pocket is generally tubular and circumferentially displaced about the form-fitting clothing article.

11. The sportswear garment of claim 1 wherein the pocket is generally tubular and spirally displaced about the form-fitting clothing article.

12. The sportswear garment of claim 1 wherein the form-fitting clothing article is constructed of a stretchable fabric.

13. The sportswear garment of claim 1 wherein the form-fitting clothing article is constructed of a breathable fabric.

14. The sportswear garment of claim 1 wherein the means for receiving includes a designator indicative of the at least one flexible weight capable of fitting therein.

15. The sportswear garment of claim 1 wherein the means for receiving comprises a transparent pocket and the at least one flexible weight has a color coating capable of showing through the transparent pocket thereby providing color to the form-fitting clothing article.

16. The sportswear garment of claim 1, wherein at least one of said weights comprises a resilient weight body comprising a thermoplastic elastomer polymer with a finely divided mineral filler.

17. The sportswear garment of claim 16, wherein said mineral filler has an average particle size of 5 to 200 $\mu$m.

18. The sportswear garment of claim 16, wherein said weight further comprises an expandible knit covering substantially covering an exterior of said body.

19. An exercise garment comprising:

a clothing article capable of conforming to the body of a wearer, fitting on either the upper or lower torso, the clothing article having an exterior surface;

a plurality of flexible elongate weights, each of the weights being resilient such that each of the weights generally conforms to said body of the wearer alone the length of the weight to generally conform to the curvature and movement of said body of a wearer;

means integral to the clothing article for removably carrying the flexible weights constructed and arranged at any of a variety of different fixed and predetermined locations on the exterior surface of the clothing article, the means for removably carrying the weight and holding the weight to generally fit against said body of a wearer along the length of the weight.

20. An exercise garment comprising:

a clothing article capable of conforming to the body of a wearer, the clothing article having an exterior surface;

a plurality of flexible elongate weights;

means for removably carrying the plurality of weights constructed and arranged in various orientations on the exterior surface of the clothing article, wherein at least one of the orientations is spirally-oriented.

21. A resilient, flexible, elongate weight for use with an exercise garment worn closely against a body of a wearer, the garment holding the weight generally against the body, the weight being capable of flexing to generally match the natural contour and movement of the body of a wearer, the weight comprising:

a formed weight body comprising a thermoplastic elastomer polymer with a finely divided mineral filler.

22. A weight according to claim 21, wherein said thermoplastic polymer is selected from the group consisting of: silicon rubber; styrene butadiene rubber; ethylene propylene rubber; EPDM rubber; polybutadiene rubber; and polyisoprene rubber.

23. A weight according to claim 21, wherein said mineral filler includes at least one metal powder.

24. A weight according to claim 21, wherein said mineral filler has an average particle size of 5 to 200 $\mu$m.

25. A weight according to claim 21, wherein said mineral filler is selected from the group consisting of iron and lead.

26. A weight according to claim 21, wherein said body includes about 5–50% thermoplastic elastomer by weight.

27. A weight according to claim 21, wherein said body includes about 15–21% thermoplastic elastomer by weight.

28. A weight according to claim 21, further comprising an expandible knit covering substantially covering an exterior of said body.

29. A weight according to claim 21, wherein said expandible knit covering is a synthetic fabric.

30. A weight according to claim 21, further comprising:

a plastically bendable member disposed within said weight body to maintain the weight body at a selected shape upon manual bending manipulation.

31. A weight according to claim 30 configured for use as an exercise aid, the weight being elongated in shape flexibly securable around a human limb in an end-to-end manner.

32. A weight according to claim 21, wherein said weight body is elongated in shape, said weight further comprising:

means for fastening said weight in a generally end-to-end fashion so that the weight is securable circumferentially around a body member.

33. A method of making a weight, the method comprising the steps of:

mixing a thermoplastic elastomer with a finely divided mineral filler to form a mixture;

forming the mixture into a desired weight shape.

34. A method according to claim 33, wherein the mixing step includes providing an amounts of thermoplastic elastomer and filler such that the mixture contains 5–10% thermoplastic elastomer.

35. A method according to claim 33, wherein the mineral filler is a metal powder having an average particle size of 5 to 200 $\mu$m.

36. A method according to claim 32, wherein said forming step includes extruding the mixture.

37. A method according to claim 36, wherein said forming step further includes cutting the extruded mixture into weight body segments.

38. A sportswear garment comprising:

a clothing article which can be worn around either the upper or lower torso of a user's body;

at least one elastic pocket integral to the clothing article; and a flexible elongate weight shaped to be cooperatively receivable within said elastic pocket in a secure and generally immobile manner so that the elongate weight is held closely against said torso, said weight comprising a thermoplastic elastomer with a mineral filler interspersed therein.

39. The garment according to claim 1, wherein the pockets are further arranged in a plurality of orientations on the clothing article.

40. The garment according to claim 39, wherein at least one of said orientations is spirally-oriented.

41. The garment according to claim 1, wherein each weight is torsionally flexible lengthwise direction along the weight.

42. The garment according to claim 20, wherein said means comprises a plurality of pockets integral to the garment.

43. The garment according to claim 20, wherein the means hold the weights in any of a plurality of a selected fixed and predetermined orientations on the clothing article.

44. The garment according to claim 43, wherein at least one of the orientations is spirally-oriented.

* * * * *